US006659749B2

(12) United States Patent
Esumi et al.

(10) Patent No.: US 6,659,749 B2
(45) Date of Patent: Dec. 9, 2003

(54) HERMETIC COMPRESSOR AND OPEN COMPRESSOR

(75) Inventors: Mototaka Esumi, Shiga (JP); Osamu Aiba, Shiga (JP); Shuichi Yamamoto, Shiga (JP)

(73) Assignee: Matsushita Electric Industrial Co., LTD, Kadoma (JP)

( * ) Notice: Subject to any disclaimer, the term of this patent is extended or adjusted under 35 U.S.C. 154(b) by 107 days.

(21) Appl. No.: 10/053,890

(22) Filed: Jan. 17, 2002

(65) Prior Publication Data

US 2002/0090311 A1 Jul. 11, 2002

Related U.S. Application Data

(62) Division of application No. 09/941,644, filed on Aug. 30, 2001, which is a division of application No. 09/411,646, filed on Oct. 4, 1999, now Pat. No. 6,302,665.

(30) Foreign Application Priority Data

Oct. 5, 1998 (JP) ..... 10-299150

(51) Int. Cl.[7] ..... F04C 15/00

(52) U.S. Cl. ..... 418/179; 418/178; 418/63; 418/68; 418/55.1; 418/55.3

(58) Field of Search ..... 418/178, 179, 418/55.1, 55.3, 63; 252/68

(56) References Cited

U.S. PATENT DOCUMENTS

| | | | | |
|---|---|---|---|---|
| 4,861,372 A | | 8/1989 | Shimomura | |
| 4,904,302 A | | 2/1990 | Shimomura | |
| 4,944,663 A | | 7/1990 | Iizuka et al. | |
| 5,364,248 A | * | 11/1994 | Nakashima et al. | 29/898.1 |
| 5,518,381 A | * | 5/1996 | Matsunaga et al. | 418/100 |
| 5,548,973 A | * | 8/1996 | Komine et al. | 252/68 |
| 5,653,909 A | * | 8/1997 | Muraki et al. | 252/67 |
| 5,842,846 A | * | 12/1998 | Fukuoka et al. | 418/63 |
| 5,964,581 A | | 10/1999 | Iizuka et al. | |
| 6,029,459 A | | 2/2000 | Iizuka et al. | |
| 6,071,100 A | * | 6/2000 | Yamada et al. | 418/55.3 |
| 6,223,554 B1 | * | 5/2001 | Adachi | 252/68 |

FOREIGN PATENT DOCUMENTS

| | | |
|---|---|---|
| JP | 53-125608 A1 | 2/1979 |
| JP | 51-124813 A1 | 2/1980 |
| JP | 56-047550 A1 | 4/1981 |
| JP | 57-008388 A1 | 1/1982 |
| JP | 09-137784 A1 | 5/1997 |
| JP | 11-303782 A1 | 11/1999 |

* cited by examiner

*Primary Examiner*—Thomas Denion
*Assistant Examiner*—Theresa Trieu
(74) *Attorney, Agent, or Firm*—Armstrog, Westerman & Hattori, LLP

(57) ABSTRACT

The present invention provides a hermetic or open compressor for hydrocarbon refrigerant having high reliability. According to the present invention, in the compressor using hydrocarbon as refrigerant, synthetic oil such as polyalkylene glycol oil, ester oil or ether oil is used as freezer oil. Sliding member of the compressor includes both a portion made of aluminum material and a portion made of iron material. Therefore, it is possible to realize a compressor having excellent wear resistance and high reliability.

14 Claims, 5 Drawing Sheets

HERMETIC COMPRESSOR AND OPEN COMPRESSOR

This application is a division of prior application Ser. No. 09/941,644, filed Aug. 30, 2001, which is a division of prior application Ser. No. 09/411,646, filed Oct. 4, 1999 now U.S. Pat. No 6,302,665.

TECHNICAL FIELD

The present invention relates to a compressor having sliding members which are excellent in wear resistance, and more particularly, to a hermetic compressor and an open compressor using hydrocarbon refrigerant (which will be referred to as "HC refrigerant" hereinafter) and mineral oil or synthetic oil.

BACKGROUND TECHNIQUE

A freezer such as air conditioner, refrigerator and car cooler includes a refrigerating cycle. A hermetic compressor or an open compressor for circulating refrigerant is incorporated in the refrigerating cycle. The hermetic compressor includes a hermetic case in which a motor and a compression machine driving by this electric motor are accommodated. Compressor refrigerant is compressed, heated to high temperature and pressurized by this compression machine and discharged into the refrigerating cycle. Some conventional hermetic compressors use CFC12 refrigerant (which will be referred to as "R12 refrigerant" hereinafter) which is one kind of chlorofluorocarbon, HCFC22 refrigerant (which will be referred to as "R22 refrigerant" hereinafter) which is one kind of hydrochlorofluorocarbon, or naphthene or paraffin mineral oil having excellent compatibility with the R12 refrigerant or R22 refrigerant.

When the R12 refrigerant is used as compressor refrigerant, chlorine atoms included in the R12 refrigerant reacts with iron atoms of metal base material to form chlorine lubricant films. The lubricant film comprising the ferric chloride has self-lubricating properties and is excellent in wear resistance and prevents contact between metals to effectively prevent the wear. In addition, since the R12 refrigerant and conventional freezer oil are nonpolar, hygroscopicity is low. Therefore, the ferric chloride layer formed on iron-based metal base material does not cause hydrolytic degradation and exists as a stable lubricant film. However, since the R12 refrigerant is extremely stable chemically in the atmosphere and there is a high possibility that the R12 refrigerant destroys the ozone layer, the R12 refrigerant is designated as a restricted chlorofluorocarbon. Further, the R22 refrigerant is also a restricted chlorofluorocarbon although it is easily decomposed in the atmosphere and it has weak power to destroy the ozone layer, since the R22 still have effect to destroy the ozone layer, it has been decided internationally that the R22 refrigerant should not be used in the feature.

Recently, hydro-fluorocarbon refrigerant (which will be referred to as "HFC refrigerant" hereinafter) which does not destroy the ozone layer is developed as alternative chlorofluorocarbon as an alternative to specified chlorofluorocarbon or designated chlorofluorocarbon. Although the ozone destroy coefficient of the HFC refrigerant is zero, since it does not have chlorine atoms, there is a problem that the self-lubricating property is inferior. Further, when the hermetic compressor is operated using the HFC refrigerant as the compressor refrigerant, if the naphthene or paraffin mineral oil is used as the freezer oil, the compatibility with the HFC refrigerant is bad. Since such mineral oil is not solved into the HFC refrigerant, oil returning property is bad, lubricating and cooling effects of sliding portions of the compressor are impaired, and there is a possibility that problem such as seizing up is caused. Further, although the HFC refrigerant does not destroy the zone layer, since global-warming coefficient is thousands of times of carbon dioxide, it can be said that the HFC refrigerant is not sufficient in terms of terrestrial environment.

Thereupon, HC refrigerant and ammonia refrigerant are proposed as refrigerant which is not harmful to environment recently. The ammonia refrigerant attacks copper such as copper wire and thus, it is difficult to use it in the hermetic compressor. It is known that the HC refrigerant does not have the above-described problem of the ammonia refrigerant and has excellent characteristics as refrigerant for air conditioner. Naphthene or paraffin mineral oil is generally used as the freezer oil, but when the compatibility of combination of the HC refrigerant, the freezer oil and the sliding members is bad, the wear of the sliding members is increased. Thereupon, appropriate combination of the HC refrigerant, the freezer oil and the sliding members is necessary.

If the hermetic compressor or open compressor is driven for practical test using mineral oil, since the sliding members are worn, it is necessary to use material for the sliding members in which wear resistance is enhanced. Further, rather than naphthene or paraffin mineral oil, polyalkylene glycol (which will be referred to as "PAG oil" hereinafter), ester oil having ester linkage in molecular (which will simply be referred to as "ester oil" hereinafter), or ether oil having ether linkage in molecular (which will simply be referred to as "ether oil" hereinafter) may be used as the freezer oil in some cases, and it is necessary to provide the sliding members suitable for respective freezer oils. Thereupon, the present invention has been accomplished in view of the above circumstances, and it is an object to provide a hermetic compressor or an open compressor in which the wear resistance of sliding portions of a compressor is enhanced, stably driving for a long term period can be ensured, and HC refrigerant can be used.

DISCLOSURE OF THE INVENTION

To achieve the above objects, according to a first aspect of the present invention, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor comprise a sliding portion made of aluminum material and a sliding portion made of iron material.

Further, to achieve the above objects, according to a second aspect, the sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide. According to a third aspect, the sliding portion made of iron material such as copper, cast iron sintered iron is subjected nitriding or sulfurizing nitriding, and a white layer and nitrogen-dispersed hardened layer are formed on a sliding surface of the sliding portion. According to a fourth aspect, the sliding portion made of iron material such as copper, cast iron sintered iron is subjected to PVD, CVD and plating to form a hardening treatment layer. Further, to achieve the above object, according to a fifth aspect, the hermetic compressor is a reciprocating compressor, a connecting rod belongs to the sliding portion made of aluminum material, a crankshaft belongs to the sliding portion made of iron material. According to a sixth aspect, the hermetic compressor is a scroll compressor, a movable lap belongs to the sliding portion made of aluminum material, a crankshaft, an Oldham ring or a stationary lap belongs to the sliding portion made of iron material.

According to the hermetic compressor of first to sixth aspects, in HC refrigerant, mineral oil or synthetic oil such as PAG oil, ester oil and ether oil is used as the freezer oil. The sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide. Therefore, wear resistance is extremely excellent, and when steel, cast iron or sintered iron is used as iron-based material for the other member, the iron-based material exhibits excellent wear resistance. In order to further enhance the wear resistance, the sliding portion made of iron material is subjected nitriding or sulfurizing nitriding, and a white layer and nitrogen-dispersed hardened layer are formed on a sliding surface of the sliding portion and thus, a sliding member having extremely excellent wear resistance is provided. If the other iron-based material is subjected to PVD, CVD and plating, adhesion properties and wear resistance are enhanced. In the actual hermetic compressor, in the case of the reciprocating type compressor, the connecting rod is made of aluminum alloy material, one of parts is a crankshaft made of iron-based material. In the case of a scroll type compressor, a movable lap is made of aluminum alloy, and one of parts is a crankshaft, Oldham ring or a stationary lap made of iron-based material. Such a hermetic compressor has extremely high reliability.

To achieve the above object, according to a seventh aspect, there is provided an open compressor comprising a case in which a compression machine is accommodated, and hydrocarbon refrigerant being used as refrigerant to be compressed by the compression machine, wherein mineral oil or synthetic oil being used as refrigerant for lubricating sliding portions of the open compressor, and the sliding portions of the hermetic compressor comprise a sliding portion made of aluminum material and a sliding portion made of iron material.

To achieve the above object, according to an eighth aspect, the sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide. According to a aspect, the sliding portion made of iron material is subjected nitriding or sulfurizing nitriding, and a white layer and nitrogen dispersed hardened layer are formed on a sliding surface of the sliding portion. According to a aspect, the sliding portion made of iron material has a sliding surface on which a hardening treatment layer is formed. Further, to achieve the above object, according to an eleventh aspect, the open compressor is a scroll compressor, a movable lap belongs to the sliding portion made of aluminum material, a crankshaft or a Oldham ring belongs to the sliding portion made of iron material. According to a twelfth aspect, the open compressor is a scroll compressor, a vane belongs to the sliding portion made of aluminum material, a rotor or a cylinder belongs to the sliding portion made of iron material.

According to the open compressor of seventh to twelfth aspects, in HC refrigerant, mineral oil or synthetic oil such as PAG oil, ester oil and ether oil is used as the freezer oil. The sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide. Therefore, wear resistance is extremely excellent, and when steel, cast iron or sintered iron is used as iron-based material for the other member, the iron-based material exhibits excellent wear resistance. In order to further enhance the wear resistance, the sliding portion made of iron material is subjected nitriding or sulfurizing nitriding, and a white layer and nitrogen-dispersed hardened layer are formed on a sliding surface of the sliding portion and thus, a sliding member having extremely excellent wear resistance is provided. If the other iron-based material is subjected to PVD, CVD and plating, adhesion properties are further enhanced and wear resistance is also enhanced. In the actual open compressor, in the case of the scroll type compressor, a movable lap is made of aluminum alloy material, one of parts is a crankshaft, Oldham ring or a stationary lap made of iron-based material. In the case of a sliding vane type compressor, a vane is made of aluminum alloy material, a rotor or cylinder is made of iron-based material. Such an open compressor has extremely high reliability.

Further, according to a thirteenth aspect, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor are made of cast iron including graphite flake or cast iron material including eutectic graphite. To achieve the above object, according to a fourteenth aspect, the sliding portion has a sliding surface which is subjected to phosphoric acid manganese treatment or molybdenum disulfide treatment, or which is subjected to phosphoric acid manganese treatment and then formed with surface treatment layer of molybdenum disulfide. According to a fifteenth aspect, the hermetic compressor is a scroll compressor, a movable lap and a stationary lap are sliding portions made of cast iron including graphite flake or cast iron material including eutectic graphite.

According to the thirteenth to fifteenth aspects, in HC refrigerant, mineral oil or synthetic oil such as PAG oil, ester oil and ether oil is used as the freezer oil. The sliding member is made of graphite flake cast iron or eutectic graphite cast iron, and the sliding portion has a sliding surface which is subjected to phosphoric acid manganese treatment or molybdenum disulfide treatment, or which is subjected to phosphoric acid manganese treatment and then formed with surface treatment layer of molybdenum disulfide. Therefore, wear resistance is excellent. In the actual scroll compressor, the movable lap and the stationary lap are sliding portions made of cast iron including graphite flake or cast iron material including eutectic graphite. Such a hermetic compressor has extremely high reliability.

To achieve the above object, according to a sixteenth aspect, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, the sliding portions of the hermetic compressor are made of cast iron material including spherical graphite having tensile strength of 50 kg/mm$^2$ or greater, and a bearing is made of cast iron including spherical graphite having tensile strength of 20 kg/mm$^2$ or greater or made of sintered iron having tensile strength of 20 kg/mm$^2$ or greater. According to a seventeenth aspect, the hermetic compressor is a reciprocating compressor, a crankshaft is made of cast iron including spherical graphite having tensile strength of 50 kg/mm$^2$ or greater, a bearing fixed to a stationary frame is made of graphite flake having tensile strength of 20 kg/mm$^2$ or greater or made of sintered iron having tensile strength of 20 kg/mm$^2$ or greater. According to an eighteenth aspect, the hermetic compressor is a rotary compressor, a crankshaft is made of cast iron including spherical graphite having tensile strength of 50 kg/mm$^2$ or greater, the bearing is made of graphite flake having tensile strength of 20 kg/mm$^2$ or greater or made of sintered iron having tensile strength of 20 kg/mm or greater. According to a nineteenth aspect, the hermetic compressor is a scroll compressor, a crankshaft is made of cast iron including spherical graphite having tensile strength of 50 kg/mm or greater, a main bearing is made of graphite flake having tensile strength of 20 kg/mm$^2$ or greater or made of sintered iron having tensile strength of 20 kg/mm$^2$ or greater.

According to the sixteenth to nineteenth aspects, in HC refrigerant, mineral oil or synthetic oil such as PAG oil, ester oil and ether oil is used as the freezer oil. One of the sliding members is made of cast iron material including spherical graphite having tensile strength of 50 kg/mm$^2$ or greater, and the other sliding member is made of cast iron including spherical graphite having tensile strength of 20 kg/mm$^2$ or greater or made of sintered iron having tensile strength of 20 kg/mm$^2$ or greater. Such a compressor is extremely excellent in wear resistance. In the actual reciprocating hermetic compressor, the one sliding member is the crankshaft and the other sliding member is the bearing fixed to the stationary frame. In the rotary compressor, the one sliding member is the crankshaft and the other sliding member is the main or auxiliary bearing. In the scroll compressor, the one sliding member is the crankshaft and the other sliding member is the main bearing. Such a hermetic compressor has extremely high reliability.

To achieve the above object, according to a twentieth aspect, there is provided an open compressor comprising a case in which a compression machine is accommodated, and hydrocarbon refrigerant being used as refrigerant to be compressed by the compression machine, wherein mineral oil or synthetic oil being used as refrigerant for lubricating sliding portions of the open compressor, the sliding portions of the open compressor are made of cast iron material including spherical graphite having tensile strength of 50 kg/mm$^2$ or greater, and partner sliding portions are made of cast iron including graphite flake having tensile strength of 20 kg/mm$^2$ or greater or made of sintered bearing material having tensile strength of 20 kg/mm$^2$ or greater. According to a twenty-first aspect, the hermetic compressor is a reciprocating compressor, a crankshaft is made of cast iron material including spherical graphite having tensile strength of 20 kg/mm$^2$ or greater, a bearing fixed to a stationary frame is made of graphite flake having tensile strength of 20 kg/mm$^2$ or greater or made of sintered iron having tensile strength of 20 kg/mm$^2$ or greater.

According to a twenty-second aspect, the hermetic compressor is a rotary compressor, a crankshaft is made of cast iron including spherical graphite having tensile strength of 50 kg/mm$^2$ or greater, the bearing is made of cast iron material including graphite flake having tensile strength of 20 kg/mm$^2$ or greater or made of sintered bearing material having tensile strength of 20 kg/mm$^2$ or greater.

According to a twenty-third aspect, the hermetic compressor is a scroll compressor, a crankshaft is made of cast iron including spherical graphite having tensile strength of 50 kg/mm$^2$ or greater, a main bearing is made of cast iron material including graphite flake having tensile strength of 20 kg/mm$^2$ or greater or made of sintered bearing material having tensile strength of 20 kg/mm$^2$ or greater.

According to the open compressor of the twentieth to twenty-third aspects, in HC refrigerant, mineral oil or synthetic oil such as PAG oil, ester oil and ether oil is used as the freezer oil. One of the sliding members is made of cast iron material including spherical graphite having tensile strength of 50 kg/mm$^2$ or greater, and the other sliding member is made of cast iron including spherical graphite having tensile strength of 20 kg/mm$^2$ or greater or made of sintered iron having tensile strength of 20 kg/mm$^2$ or greater. Such a compressor is extremely excellent in wear resistance. In the actual reciprocating hermetic compressor, the one sliding member is the crankshaft and the other sliding member is the bearing fixed to the stationary frame. In the rotary compressor, the one sliding member is the crankshaft and the other sliding member is the main or auxiliary bearing. In the scroll compressor, the one sliding member is the crankshaft and the other sliding member is the main bearing. Such a hermetic compressor has extremely high reliability.

To achieve the above object, according to a twenty-fourth aspect, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor comprise both a sliding portion made of SKH51 material and a sliding portion made of cast iron material including graphite flake having 10% or less of ferrite or made of cast iron material including eutectic graphite having 50% or less of pearlite.

According to a twenty-fifth aspect, the hermetic compressor is a rotary compressor, the compressor comprises a vane is made of SKH51 material, and a cylinder made of cast iron material including graphite flake having 10% or less of ferrite or made of cast iron material including eutectic graphite having 50% or less of pearlite.

According to the twenty-fourth and twenty-fifth aspects, in HC refrigerant, mineral oil or synthetic oil such as PAG oil, ester oil and ether oil is used as the freezer oil. One of the sliding member is made of SKH51 material, and the other sliding member is made of cast iron material including graphite flake having 10% or less of ferrite or made of cast iron material including eutectic graphite having 50% or less of pearlite. In the actual case, the hermetic compressor is a rotary compressor, the one sliding member is a vane and the other sliding member is a cylinder. Such a hermetic compressor has extremely high reliability.

To achieve the above object, according to a twenty-sixth aspect, there is provide a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor comprise both a sliding portion made of SKH51 material and a sliding portion made of sintered and tempered nickel-chromium-molybdenum cast iron material including 0.4 to 1.0 weight % of chromium oxide and hardness of HRC45 or greater. According to a twenty-seventh aspect, the hermetic compressor is a rotary compressor, a vane belongs to a sliding portion made of SKH51 material, and a piston belongs to a sliding portion made of sintered and tempered nickel-chromium-molybdenum cast iron material including 0.4 to 1.0 weight % of chromium oxide and hardness of HRC45 or greater.

According to the twenty-sixth and twenty-seventh aspects, in HC refrigerant, mineral oil or synthetic oil such as PAG oil, ester oil and ether oil is used as the freezer oil. One of the sliding member is made of SKH51 material, and the other sliding member is made of made of sintered and tempered nickel-chromium-molybdenum cast iron material including 0.4 to 1.0 weight % of chromium oxide and hardness of HRC45 or greater. In the actual case, the hermetic compressor is a rotary compressor, the one sliding member is a vane and the other sliding member is a piston. Such a hermetic compressor has extremely high reliability.

To achieve the above object, according to a twenty-eighth aspect, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and bearing sliding portions constituting the sliding portions of the hermetic compressor are made of sintered iron material having sintering density of 6.5 g.cm$^3$.

According to a twenty-ninth aspect, the bearing sliding portions are made of bearing sintered iron material having metal including 1 to 3 weight % of copper, 0.5 to 0.9 weight % of carbon and a balance mainly comprising iron.

According to a thirtieth aspect, the bearing sliding portions are made of sintered iron material sealed with self-lubricating material such as ethylene tetrafluoride, molybdenum sulfide, copper, tin and bronze.

According to the twenty-eighth to thirtieth aspects, in HC refrigerant, mineral oil or synthetic oil such as PAG oil, ester oil and ether oil is used as the freezer oil. The sliding member is made of sintered iron material having sintering density of 6.5 g.cm$^3$, or made of bearing sintered iron material having metal including 1 to 3 weight % of copper, and 0.5 to 0.9 weight % of carbon, or made of of sintered iron material sealed with self-lubricating material such as ethylene tetrafluoride, molybdenum sulfide, copper, tin and bronze. Such a hermetic compressor has extremely high reliability.

To achieve the above object, according to a thirty-first aspect, there is provided a hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor comprise both a sliding portion having a sliding surface which is nitrided and formed with a white layer, and a sliding portion made of sintered and tempered nickel-chromium-molybdenum cast iron material including 0.4 to 1.0 weight % of chromium.

According to a thirty-second aspect, the hermetic compressor is a rotary compressor, a vane belongs to a sliding portion having a sliding surface which is nitrided and formed with a white layer, and a roller belongs to a sliding portion made of sintered and tempered nickel-chromium-molybdenum cast iron material including 0.4 to 1.0 weight % of chromium, and at least a tip end of the vane has a nitrided white layer.

According to a thirty-third aspect, the vane is made of SKH material or melted SUS material, a surface of the vane is nitrided, and the surface is formed with the white layer of 3 $\mu$m or greater.

According to the thirty-first to thirty-third aspects, in HC refrigerant, mineral oil or synthetic oil such as PAG oil, ester oil and ether oil is used as the freezer oil. One of the sliding members is nitrided and formed at its surface with a white layer, and the other sliding members is made of sintered and tempered nickel-chromium-molybdenum cast iron material including 0.4 to 1.0 weight % of chromium and hardness of HRC45 or greater. In actual case, the hermetic compressor is a rotary compressor, and one of the sliding members is a vane and the other sliding member is a piston. Such a hermetic compressor has extremely high reliability.

To achieve the above object, according to a thirty-fourth aspect, there is provided a rotary hermetic compressor comprising a hermetic case in which a motor and a compression machine are accommodated, and hydrocarbon refrigerant being used as refrigerant to be compressed by the compression machine, wherein freezer oil for lubricating sliding portions of the hermetic compressor is mineral oil or synthetic oil, and the sliding portions of the hermetic compressor has both a sliding portion made of iron-based sintered material including chromium carbide, or sintered SKH material or SUS material, and a sliding portion made of sintered and tempered nickel-chromium-molybdenum cast iron material including 0.4 to 1.0 weight % of chromium and hardness of HRC45 or greater.

According to a thirty-fifth aspect, the hermetic compressor is a rotary compressor, a vane belongs to the sliding portion made of iron-based sintered material including chromium carbide, or sintered SKH material or SUS material, a roller belongs to the sliding portion made of sintered and tempered nickel-chromium-molybdenum cast iron material including 0.4 to 1.0 weight % of chromium and hardness of HRC45 or greater, and the material of the vane includes 60 weight % or greater of SKH51 sintered material.

According to the thirty-fourth and thirty-fifth aspects, in HC refrigerant, mineral oil or synthetic oil such as PAG oil, ester oil and ether oil is used as the freezer oil. One of the sliding members is made of sintered material including chromium carbide, or sintered SKH material or SUS material, and the other sliding member is made of sintered and tempered nickel-chromium-molybdenum cast iron material including 0.4 to 1.0 weight % of chromium and hardness of HRC45 or greater. In actual case, the hermetic compressor is a rotary compressor, and one of the sliding members is a vane and the other sliding member is a piston. Such a hermetic compressor has extremely high reliability.

BEST MODE FOR CARRYING OUT THE INVENTION

In the present invention, HC refrigerant used for a hermetic or open compressor is hydrocarbon such as methane, ethane, propane, butane and isobutane. Freezer oil for lubricating sliding portions of the compressor of the present invention is mineral oil such as paraffin oil, cryogenic dewaxed paraffin oil, low-refined naphthene oil, highly-refined naphthene oil; polyalkylene glycol, i.e., PAG oil as synthetic oil, so-called ester oil having one or plurality of ester linkages in molecular, or so-called ether oil having one or plurality of ether linkages in molecular.

The hermetic compressor of the present invention is incorporated in a refrigerating cycle of a freezer such as a refrigerator and freezer showcase or an air conditioner for cooling or heating a room. The hermetic compressor is broadly divided into reciprocating type, rotary type and scroll type. The open compressor of the present invention is incorporated in an air conditioner for a vehicle, and is broadly divided into sliding vane type, swash plate type and scroll type.

An embodiment to which the present invention can be applied will be explained below with reference to the drawings.

Figure 1:
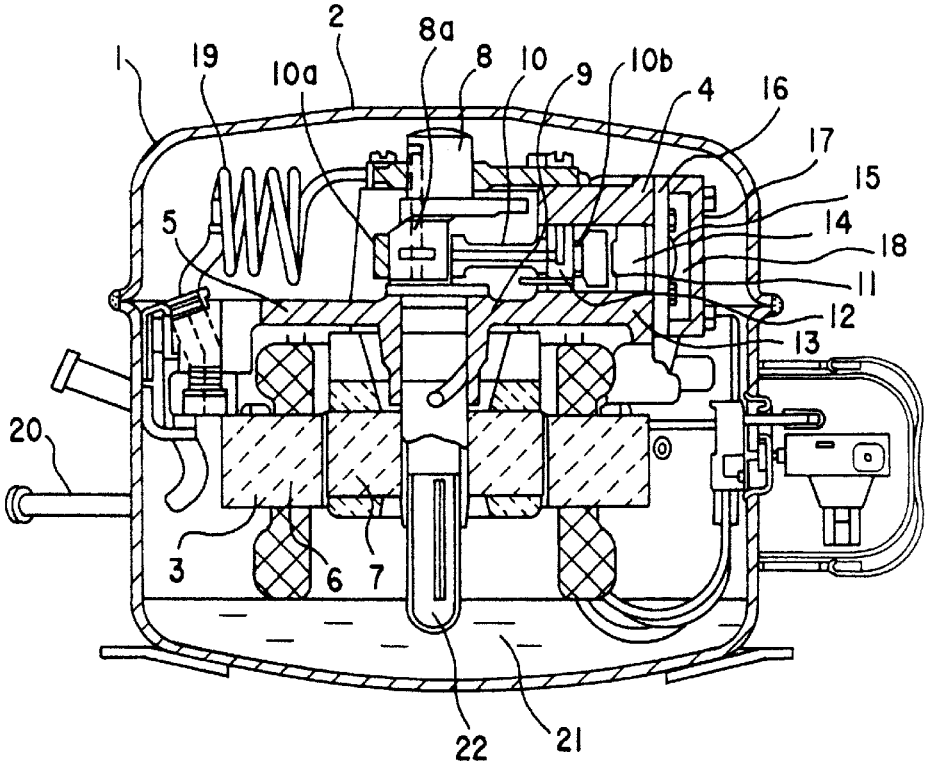
FIG. 1 is a vertical sectional view showing a reciprocating type hermetic compressor to which the present invention can be applied.

FIG. 1 shows a reciprocating type hermetic compressor. The hermetic compressor 1 has a hermetic case 2 in which a lower motor 3 and a compression machine 4 driven by the motor 3 are accommodated. The motor 3 and the compression machine 4 are integrally incorporated in a homogenous frame 5. The motor 3 includes a stator 6 and a rotor 7, and a crankshaft 8 which rotates together with the rotor 7 is rotatably supported by a bearing 9 of the stationary frame 5.

A crank portion 8*a* of the crankshaft 8 is formed on the bearing 9 such as to project upward, and a large end 10*a* of a connecting rod 10 forming a piston rod is pivotally mounted to the crank portion 8*a*. A small end 10*b* of the connecting rod 10 is pivotally mounted to a piston pin 12 of a piston 11, and the piston 11 is slidably supported in a cylinder chamber 14 of a cylinder 13.

One end of the cylinder 13 is covered with a cylinder cover 17 through a head plate 16 having an intake valve which is not shown, and an intake chamber and a discharge chamber 18 are formed in the cylinder cover 17. The refrigerant in the discharge chamber 18 discharged into a discharge tube 20 outside the hermetric case 2 through a discharge pipe 19 from a discharge muffler which is not shown.

On the other hand, compressor refrigerant drawn into the hermetic case 2 from the intake tube 20 enters into an intake room from an intake chamber which is not shown, and enters from this intake room into the cylinder chamber 14. Heat insulating and compressing operation is carried out in the cylinder chamber 14 by reciprocating motion of the piston 11.

Freezer oil 21 for lubricating and cooling compressor sliding portions is retained in a bottom of the hermetic case 2. The freezer oil 21 is guided to the compressor sliding portions by an oil pump 22 formed in the crankshaft 8 for lubricating the compressor sliding portions.

Each of the compressor sliding portions is formed into a supporting structure for slidably supporting a sliding material, and comprises one sliding member and the other sliding member which is a partner member for the one sliding member. More specifically, the compressor sliding portions are the crankshaft 8 and the bearing 9; the crank portion 8*a* of the crankshaft 8 and the large end 10*a* of the connecting rod 10; the small end 10*b* of the connecting rod 10 and the piston pin 12; and the piston 11 and the cylinder 13. In order to allow iron-based metal to achieve specific purpose, the sliding members are mainly made of iron-based alloy in which at least one of the following metals is added: nickel, chromium, molybdenum, manganese, copper, tin and antimony. Examples of such iron-based alloy are cast iron, alloy steel, carbon steel, stainless steel and sintered alloy. Aluminum material may be preferably used of sliding members for the piston 11 and the connecting rod 10 so as to reduce the compressor sliding portions in weight.

HC refrigerant whose ozone destroy coefficient is zero and which is environmentally friendly is used as the compressor refrigerant. Representative examples of the HC refrigerant are methane, ethane, propane, butane and isobutane.

Mineral oil which has excellent compatibility with the HC refrigerant is used as freezer oil 21 for lubricating and cooling the compressor sliding portions of the hermetic compressor 1.

Next, the operation of the reciprocating type hermetic compressor will be explained.

When the motor 3 of the hermetic compressor 1 is energized, the motor 3 is started to rotate the rotor 7. The crankshaft 8 is rotated together with the rotor 7. The rotating torque of the motor 3 is transmitted from the crankshaft 8 to the piston 11 through the crank portion 8*a* and the connecting rod 10, thereby allowing the piston 11 to reciprocate in the cylinder 13.

As the piston 11 reciprocates, the HC refrigerant which is the compressor refrigerant is drawn into the cylinder 14 from the intake room (not shown) and compressed. The refrigerant compressed to high pressure and heated to high temperature is discharged into the discharge chamber 18 and then, guided by a discharge muffler so that noise is reduced and pulse of the discharging pressure is smoothened, and the refrigerant is discharged into the refrigerating cycle from the discharge tube 20 through a discharge pipe (not shown).

On the other hand, the compressor refrigerant from the refrigerating cycle is drawn into the hermetic case 2, and is introduced into the cylinder chamber 14 from the intake chamber (not shown) formed in the hermetic case 2 through the intake room for preparing for next refrigerant compressing operation.

Figure 2:
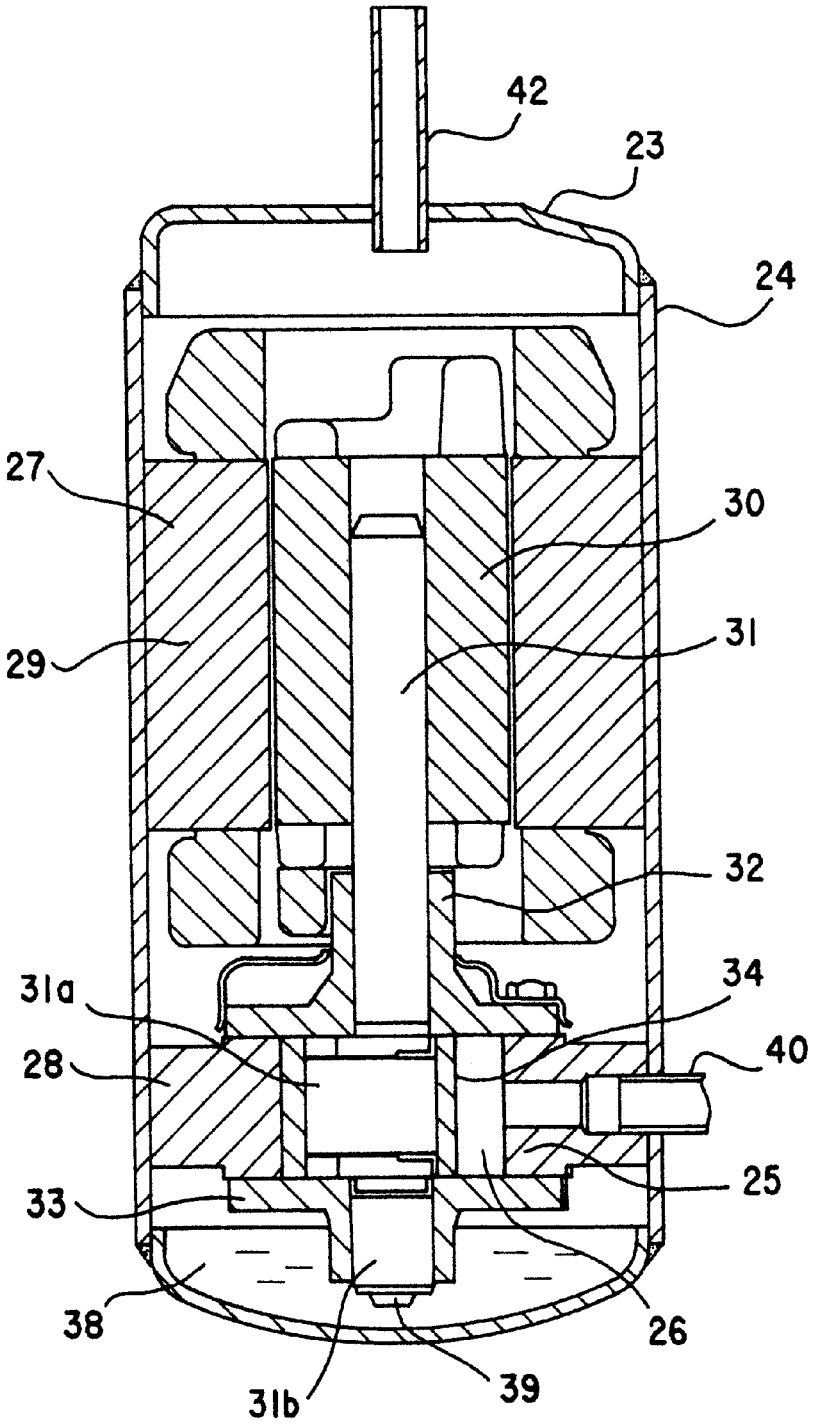
FIG. 2 is a vertical sectional view showing a rotary type hermetic compressor to which the present invention can be applied.
Figure 3:
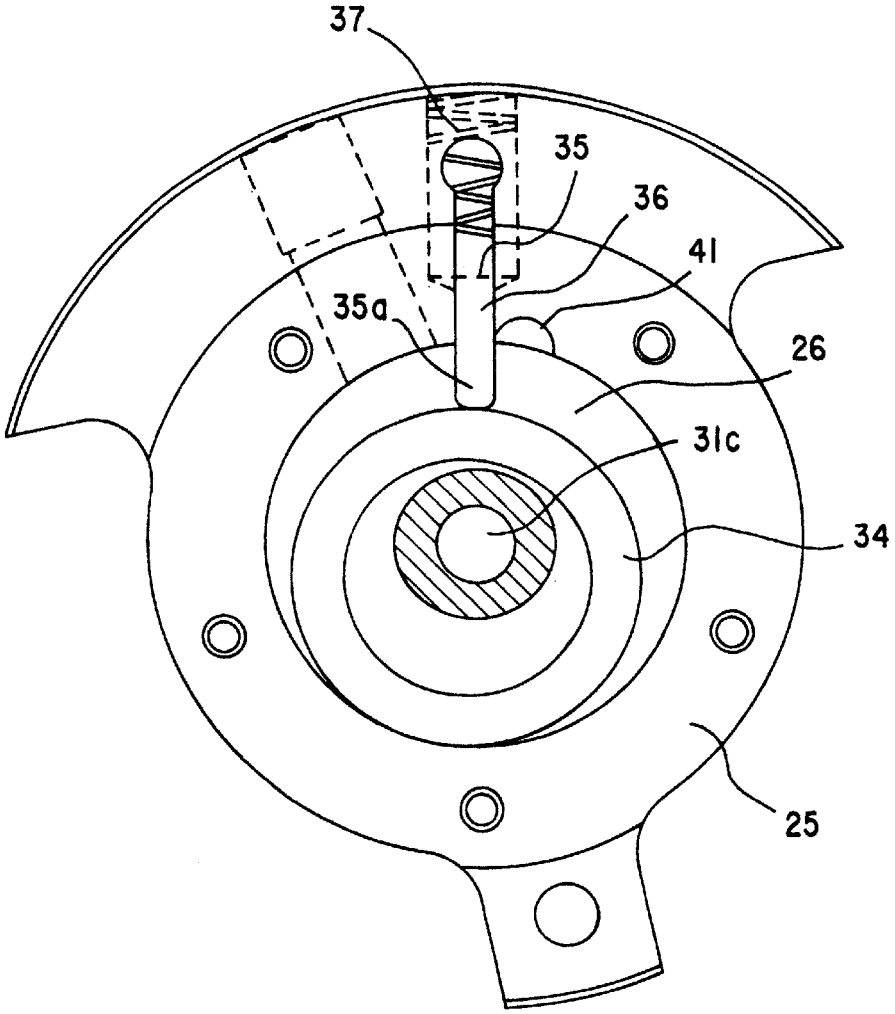
FIG. 3 is a transverse sectional view of compression machine.

FIGS. 2 and 3 are sectional views of the hermetic compressor and the compressing chamber, respectively, and show a rotary compressor incorporated in the refrigerating cycle of an air conditioner.

The compressor refrigerant is drawn into a hermetic case 24, and introduced into a compressing chamber 26 of a cylinder in the hermetic case 24.

The hermetic compressor 23 includes a hermetic case 24 in which a motor 27 and a compression machine 28 driven by the motor 27 are incorporated and accommodated. The motor 27 includes a stator 29 fitted into the hermetic case 24 and a rotor 30 accommodated in the stator 29. A crankshaft 31 is pivotally mounted to the rotor 30 such that the crankshaft 31 rotates together with the rotor 30.

[0 0 4 2]

The crankshaft 31 is rotatably supported by a main bearing 32 and an auxiliary bearing 33 both constituting the compression machine 28. The compression machine 28 defines the compressing chamber 26 in the cylinder 25 by the main bearing 32 and the auxiliary bearing 33, and a piston 34 is rotatably accommodated in the compressing chamber 26. The piston 34 is pivotally mounted to a deflection portion 31*a* of the crankshaft 31. The piston 34 rotates in the compressing chamber 26 such as to deflect its axis by the rotation of the crankshaft 31. The compressing chamber 26 in the cylinder 25 is divided by a vane 35 into an intake side and a discharge side. The vane 35 is slidably accommodated in a vane groove 36 formed in the cylinder 25, and the vane 35 is always pushed toward the piston 34 by a spring 37 formed on a back side of the vane 35 for pushing an outer layer surface of the piston 34.

Freezer oil 38 for lubricating and cooling compressor sliding portions is retained in a lower portion of the hermetic case 24. The freezer oil 38 is supplied to the compressor sliding portions through an inner diameter hole 31*c* of the crankshaft 31 by an oil pumping mechanism 39 formed at a tip end 31*b* of the crankshaft 31, thereby lubricating the compressor sliding portions. The compressor sliding portions are the crankshaft 31 and the main and auxiliary bearings 32 and 33; the piston 34 and the main and auxiliary bearings 32 and 33; the vane 35 and the piston 34; the vane groove 36 of the cylinder 25 and the vane 35; and the like. Mineral oil is used as the freezer oil 38.

Compressor refrigerant is drawn through an intake tube 40 into the compressing chamber 26 of the compression machine 28 accommodated in the hermetic case 24. Butane gas which is natural refrigerant is used as the compressor refrigerant. The compressor refrigerant drawn from the intake side of the compressing chamber 28 is compressed by rotation of the piston 34, and is guided into the hermetic case 24 from a discharge port 41. Then, the refrigerant is discharged into the refrigerating cycle from a discharge tube 42.

Figure 4:
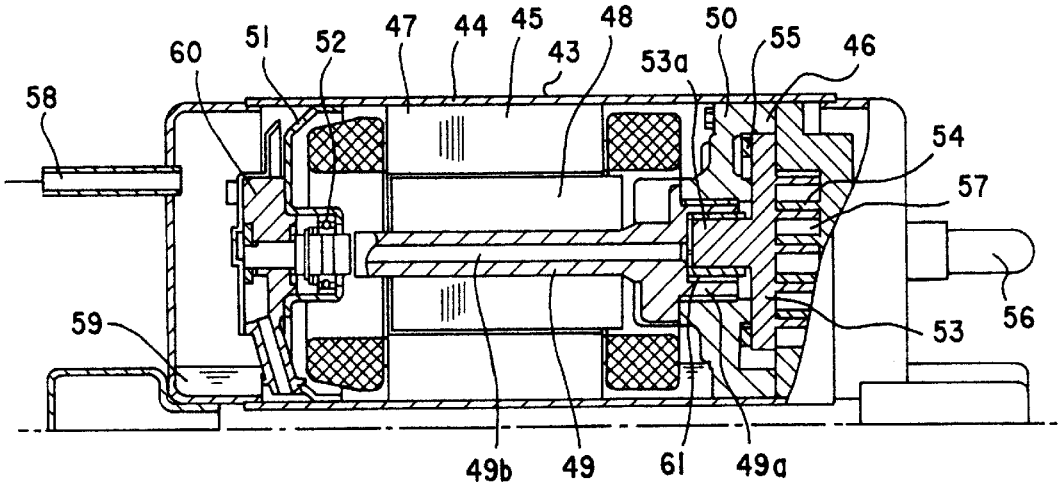
FIG. 4 is a transverse sectional view showing a scroll type hermetic compressor to which the present invention can be applied.

FIG. 4 shows a horizontal scroll hermetic compressor incorporated into a refrigerating cycle of an air conditioner. The hermetic compressor 43 includes a hermetic case 44 in which a motor 45 and a compression machine 46 driven by the motor 45 are incorporated and accommodated. The motor 45 includes a stator 47 fitted into the hermetic case 44 and a rotor 48 rotatably accommodated in the stator 47. A crankshaft 49 is mounted to the rotor 48 such that the crankshaft 49 rotates together with the rotor 48.

The crankshaft 49 extends longer than the rotor 48, and is rotatably supported by a main bearing 50 of the compressing machine 46 and a ball bearing 52 of a ball bearing fixing plate 51.

The compression machine 46 includes two laps, i.e., a revolving lap 53 and a stationary lap 54. The revolving lap 53 is sandwiched between a main bearing 50 and the stationary lap 54. The revolving lap 53 rotates by rotation of a deflection portion 49*a* of a crankshaft 49. However, the revolving lap 53 does not rotate by the Oldham ring 55 slidably incorporated in the groove of the revolving lap 53 and the groove of the main bearing 50. An outer peripheral surface of the deflection portion 49*a* of the crankshaft 49 slides on a bearing portion of the main bearing 50.

The hermetic case 44 is provided with an intake tube 56 so that butane gas as compressor refrigerant is drawn from the intake tube 56. The compressor refrigerant drawn into the hermetic case 44 is guided into a compressing chamber 57 of a compression machine 46 through a tube (not shown).

The compressor refrigerant introduced into the compressing chamber 57 is compressed by the compressing machine 46 driven by the motor 45. The compressed compressor refrigerant is guided toward the center of the stationary lap 54, discharged into the hermetic case 44 from a discharge port (not shown) formed in the center, and discharged out from the hermetic case 44 through a discharge tube 58.

Freezer oil 59 for lubricating compressor sliding portions is retained in a bottom of the hermetic case 44. The freezer oil 59 is guided to the compressor sliding portions by an oil pump 60 fixed to one end of the crankshaft 49. Mineral oil is used as the freezer oil 59.

A movable push 61 is inserted into between the deflecting portion 49*a* of the crankshaft 49 and a shaft 53*a* of the revolving lap 53.

Next, the operation of the hermetic compressor of scroll type will be explained. In this hermetic compressor 43, when the motor 45 is energized, the motor 45 is started, and the rotor 48 rotates together with the crankshaft 49. The revolving lap 53 revolves while deflecting by rotation of the crankshaft 49 without rotating, and the revolving lap 53 revolves around the stationary lap 54.

By this revolving motion, the compressor refrigerant guided into the compression chamber 57 of the compression machine 46 through the tube of the hermetic case 44 from the intake tube 56 is compressed. At that time, the compressing chamber 57 formed by the stationary lap 54 and the revolving lap 53 is shifted toward the center in a diametric direction of the stationary lap 54 while revolving, and compresses the refrigerant while reducing the volume of the compressing chamber 57 when it is shifted, the refrigerant is discharged into the hermetic case from a discharge hole formed in the center of the stationary lap 54, and is further discharged to the refrigerating cycle through the discharge tube 58.

On the other hand, by the operation of the hermetic compressor 43, the freezer oil 59 retained in the bottom of the hermetic case 44 is pumped up by an oil pump 60 operated by the crankshaft 49 which is driven for rotation by the motor 45, and the freezer oil 59 is supplied to the sliding portions such as the crankshaft 49, the main bearing 50, the movable push 61, the revolving lap 53, the stationary lap 54 and the Oldham ring 55 through the oil hole 49*b* of the crankshaft 49.

Figure 5:
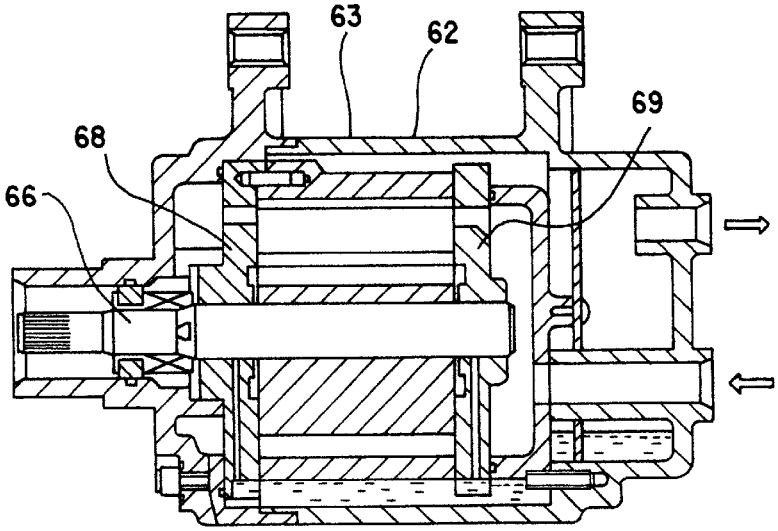
FIG. 5 is a sectional view showing a sliding vane type open compressor to which the present invention can be applied.
Figure 6:
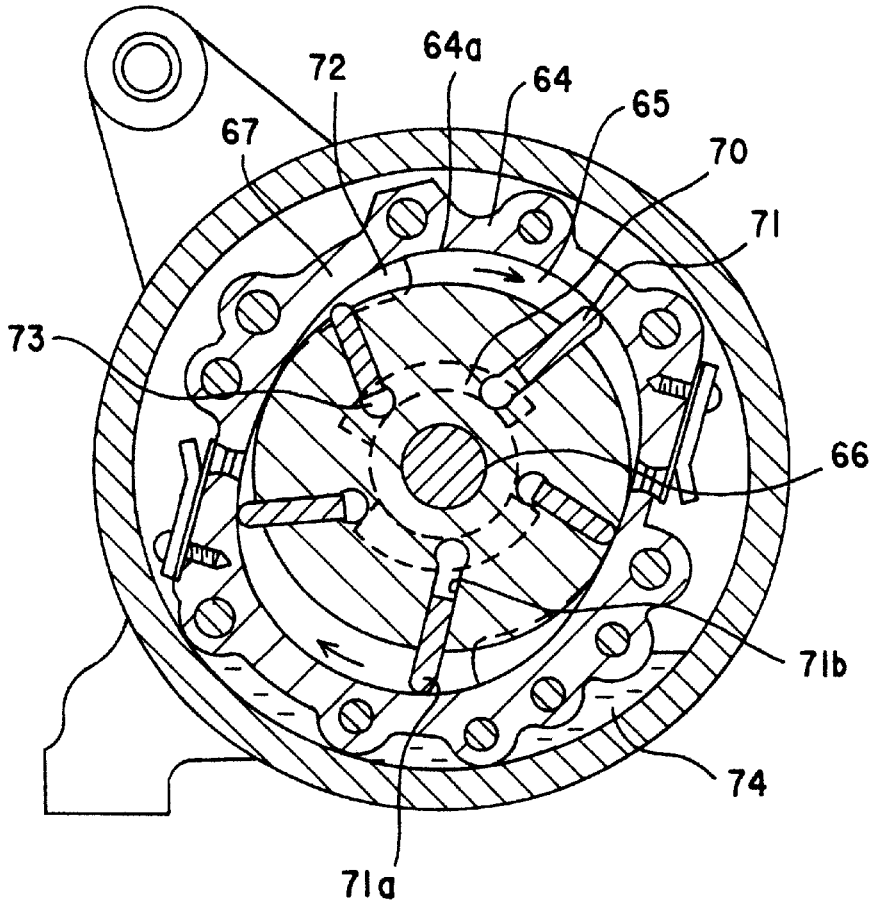
FIG. 6 is a transverse sectional view of compression machine.

FIG. 5 is a sectional view of an open compressor, and FIG. 6 is a transverse sectional view of a compressing chamber of the open compressor. This compressor is a rotary compressor of a sliding vane type incorporated in a refrigerating cycle of an air conditioner.

In this open compressor 62, refrigerant drawn into a case 63 is introduced into a compressing chamber 65 of a cylinder 64 of the case 63.

In this open compressor 62, power is transmitted to a crankshaft 66 by a motor provided outside of the case 63. The crankshaft 66 is rotated by this power, and refrigerant is compressed by a compression machine 67.

The crankshaft 66 is rotatably supported by a main bearing 68 and an auxiliary bearing 69 both constituting the compression machine 67. The compression machine 67 defines a compressing chamber 65 in a cylinder 64 by the main bearing 68 and the auxiliary bearing 69, and the crankshaft 66 and a stationary rotor 70 are rotated in the compressing chamber 65. A vane 71 which can slide in a radial direction is inserted to the stationary rotor 70 fixed to the crankshaft 66, and a tip end 71*a* of the vane 71 is brought into sliding contact with an inner periphery 64*a* of the cylinder 64 by the rotation of the rotor 70. If the compressing force becomes higher, back pressure is also applied to a rear end 71*b* of the vane 71. Refrigerant is drawn from an intake hole 72 in the compressing chamber 65 in the cylinder 64, and is compressed and discharged by the vane 71. The vane 71 is slidably accommodated in a vane 73 formed in the rotor 70.

Freezer oil 74 for lubricating and cooling the compressor sliding portions is retained in a lower portion of the case 63. The freezer oil 74 is supplied to the compressor sliding portions for lubricating the same. The compressor sliding portions are the crankshaft 66 and the main and auxiliary bearings 68 and 69; the rotor 70 and the main and auxiliary bearings 68 and 69; and the vane 71, the rotor 70 and the cylinder 64. Mineral oil is used as the freezer oil 74.

The compressor refrigerant is drawn, through an intake hole, into the compressing chamber 65 of the compression machine 67 accommodated in the case 63. Butane gas which is HC refrigerant is used as the compressor refrigerant.

Next, a combination of refrigerant of the hermetic compressor, the freezer oil and part material will be explained based on a concrete embodiment.

(First Embodiment)

In the case of the reciprocating type hermetic compressor in a first embodiment shown in FIG. 1, mineral oil is used as the freezer oil 21, the connecting rod 10 is made of aluminum alloy die cast ADC12, the piston pin 12 is made of SCM430, a surface thereof is nitrided so that a white layer of compound layer is formed. When load on the piston pin 12 is great, SUJ2 is selected as material of the piston pin 12, and its surface is subjected to PVD so that chromium nitride film is evaporated. Further, the crankshaft 8 is made of ductile iron FCD600, and a sliding surface of the crank portion 8*a* is subjected to a high frequency quenching. When load on a sliding surface of the large end 10*a* of the connecting rod 10 which slides on the crank portion 8*a* is great, bronzen bush is used, but when the load is small, the sliding surface is allowed to slide without changing the material of the connecting rod 10. Further, since FC250 is used as material of the stationary frame 5, material of the sliding surface of the bearing 9 of the stationary frame 5 is FC250, and the sliding surface slides on the bearing 9. In the case of the crankshaft 8, material of FCD600 which is subjected to a high frequency quenching (spheroidal graphite is distributed in martensite base) slides on the bearing made of FC250. When load on the crankshaft 8 is small, the material of ductile iron FCD600 (ferrite is distributed around spheroidal graphite and pearlite is distributed therearound) is used as it is, and the crankshaft 8 slides on the sliding surface of the bearing 9 of the stationary frame 5.

(Second Embodiment)

In the case of the rotary hermetic compressor 23 in a second embodiment shown in FIGS. 2 and 3, mineral oil is used as the freezer oil 38, and the crankshaft 31 is made of graphite flake cast iron FC300 or ductile iron FCD600. If wear resistance is required for the shaft, it is especially effective if the shaft is subjected to a high frequency quenching. In order to enhance the wear resistance, it is effective to nitride or nitrocarburize the crankshaft 31 after grinding. A surface of the crankshaft 31 is subjected to phosphoric acid manganese treatment, or molybdenum disulfide film is formed on the surface of the crankshaft 31 after the phosphoric acid manganese treatment. On the other hand, each of the main bearing 32 and the auxiliary bearing 33 is made of FC250 cast iron, or sintered iron containing 0.8% of carbon and 2.0% of copper at sintering density of 6.5 g/cm$^3$, and treated with vapor for sealing hole. Further, melted material of SKH51 or sintered material of SKH51 is used as material of the vane 35. When load is high, melted material of SKH51 or sintered material of SKH51 is nitrided. Further, when it is difficult to form white layer of compound layer on the SKH51 at the time of nitriding, SUS440 vane is used to carry out nitriding and form the white layer. Further, in order to prevent a tip end 35 of the vane 35 from attacking an outer periphery of the piston 34, it is effective to deposit chromium nitride only on the tip end 35*a* by PVD. On the other hand, the piston 34 is made of material of sintered and tempered FC300 including 0.5 weight % of chromium, 0.2 to 0.3 weight % of nickel and molybdenum. The cylinder 25 is made of FC250 graphite flake cast iron having pearlite base, or eutectic graphite having ferrite base in which 20% of pearlite is distributed.

(Third Embodiment)

FIG. 4 shows a scroll type hermetic compressor 43 in a third embodiment. Mineral oil is used as the freezer oil 59. The crankshaft 49 is made of FC300 graphite flake cast iron, SCM415 steel material, or ductile iron FCD600. If rigidity is required for the crankshaft 49, steal material or ductile cast iron material is necessary. If wear resistance is required for an outer peripheral portion of the deflection portion 49*a*, the outer peripheral portion of the deflection portion 49*a* is high frequency sintered or carbonitrided. The bearing portion of the main bearing 50 is made of ethylene tetrafluoride and graphite. When load is high, bronze is used. The revolving lap 53 is made of aluminum alloy, and the outer peripheral surface of the shaft 53*a* of the revolving lap 53 is subjected to phosphoric acid manganese treatment or molybdenum disulfide surface treatment, or both the phosphoric acid manganese treatment or molybdenum disulfide treatment. Further, the revolving lap 53 is made of FC250 graphite flake cast iron or eutectic graphite, and the entire surface of the revolving lap may be subjected to phosphoric acid manganese treatment, or both the phosphoric acid manganese treatment and molybdenum disulfide surface treatment. The stationary lap is made of FC250 graphite flake cast iron or eutectic graphite.

(Fourth Embodiment)

FIGS. 5 and 6 show the rotary type open compressor 62 for rotary in a fourth embodiment. Mineral oil is used as the freezer oil 74. The crankshaft 66 is made of ductile iron FCD800 or SCM415. If wear resistance is required for the shaft, high frequency sintering or carburization tempering is carried out. In order to further enhance the wear resistance, it is effective to nitride or nitrocarburize the crankshaft 86 after grinding. Each of the main bearing 68 and the auxiliary bearing 69 is made of FC250 cast iron or aluminum alloy. The vane 71 is subjected to phosphoric acid manganese treatment or molybdenum disulfide surface treatment, or the phosphoric acid manganese treatment and then molybdenum disulfide surface treatment. Although it is not illustrated in the drawings, a movable lap and the stationary lap of the open compressor of scroll type is made of aluminum, surfaces thereof are subjected to phosphoric acid manganese treatment or molybdenum disulfide surface treatment, or the phosphoric acid manganese treatment and then molybdenum disulfide surface treatment. Further, it is preferable that the crankshaft and the Oldham ring are made of iron-base material, and they are subjected to nitriding, sulfurizing nitriding, PVD, CVD and plating.

In each of the above-described compressors of the present invention, HC refrigerant can be used, wear resistance is excellent, heat stability of the freezer oil is excellent, and the compressor can be operated stably.

What is claimed is:

1. A hermetic compressor comprising a hermetic case in which a motor and a compression machine are accommodated, and hydrocarbon refrigerant being used as refrigerant to be compressed by said compression machine, wherein freezer oil for lubricating sliding portions of said hermetic compressor is mineral oil or synthetic oil, and said sliding portions of said hermetic compressor comprise a sliding portion made of aluminum material and a sliding portion made of iron material.

2. A hermetic compressor according to claim 1, wherein said sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide.

3. A hermetic compressor according to claim 1, wherein said sliding portion made of iron material is subjected nitriding or sulfurizing nitriding, and a white layer and nitrogen-dispersed hardened layer are formed on a sliding surface of said sliding portion.

4. A hermetic compressor according to claim 1, wherein said sliding portion made of iron material has a sliding surface on which a hardening treatment layer is formed.

5. A hermetic compressor according to any one of claims 1 to 4, wherein said hermetic compressor is a reciprocating compressor, a connecting rod belongs to said sliding portion made of aluminum material, a crankshaft belongs to said sliding portion made of iron material.

6. A hermetic compressor according to any one of claims 1 to 4, wherein said hermetic compressor is a scroll compressor, a movable lap belongs to said sliding portion made of aluminum material, a crankshaft, an Oldham ring or a stationary lap belongs to said sliding portion made of iron material.

7. A hermetic compressor according to claim 1, wherein the hydrocarbon refrigerant is selected from the group consisting of methane, ethane, propane, butane and isobutane.

8. An open compressor comprising a case in which a compression machine is accommodated, and hydrocarbon refrigerant being used as refrigerant to be compressed by said compression machine, wherein mineral oil or synthetic oil being used as refrigerant for lubricating sliding portions of said open compressor, and said sliding portions of said hermetic compressor comprise a sliding portion made of aluminum material and a sliding portion made of iron material.

9. An open compressor according to claim 8, wherein said sliding portion made of aluminum material has a sliding surface which is subjected to phosphoric acid manganese treatment or molybdenum disulfide treatment, or which is subjected to phosphoric acid manganese treatment and then formed with surface treatment layer of molybdenum disulfide.

10. An open compressor according to claim 8, wherein said sliding portion made of iron material is subjected nitriding or sulfurizing nitriding, and a white layer and nitrogen-dispersed hardened layer are formed on a sliding surface of said sliding portion.

11. A hermetic compressor according to claim 8, wherein said sliding portion made of iron material has a sliding surface on which a hardening treatment layer is formed.

12. An open compressor according to any one of claims 8 to 11, wherein said open compressor is a scroll compressor, a movable lap belongs to said sliding portion made of aluminum material, a crankshaft or an Oldham ring belongs to said sliding portion made of iron material.

13. An open compressor according to any one of claims 8 to 11, wherein said open compressor is a scroll compressor, a vane belongs to said sliding portion made of aluminum material, a rotor or a cylinder belongs to said sliding portion made of iron material.

14. A hermetic compressor according to claim 8, wherein the hydrocarbon refrigerant is selected from the group consisting of methane, ethane, propane, butane and isobutane.

* * * * *